US011413881B2

(12) United States Patent
Zapata et al.

(10) Patent No.: US 11,413,881 B2
(45) Date of Patent: Aug. 16, 2022

(54) DIRECT-TO-GARMENT PRINTING WITH STATIONARY PRINT NOZZLES

(71) Applicant: Hewlett-Packard Development Company, L.P., Spring, TX (US)

(72) Inventors: Maria Elizabeth Zapata, Sant Cugat del Valles (ES); Jose Luis Valero Navazo, Sant Cugat del Valles (ES); Rafael Ulacia Portoles, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/259,572

(22) PCT Filed: Mar. 29, 2019

(86) PCT No.: PCT/US2019/024962
§ 371 (c)(1),
(2) Date: Jan. 12, 2021

(87) PCT Pub. No.: WO2020/204888
PCT Pub. Date: Oct. 8, 2020

(65) Prior Publication Data
US 2022/0001676 A1 Jan. 6, 2022

(51) Int. Cl.
*B41J 3/407* (2006.01)
*B41J 11/00* (2006.01)

(52) U.S. Cl.
CPC ..... *B41J 3/4078* (2013.01); *B41J 11/002* (2013.01)

(58) Field of Classification Search
CPC ..... B41J 3/4078; B41J 11/002; B41J 11/06; B41J 29/02; D06P 5/2077; D06P 5/02; D06P 5/30
See application file for complete search history.

(56) References Cited

U.S. PATENT DOCUMENTS

| | | | | |
|---|---|---|---|---|
| 7,954,921 | B2 | 6/2011 | Ben-Zur et al. | |
| 8,931,870 | B2 | 1/2015 | Weissman et al. | |
| 9,751,312 | B1 * | 9/2017 | Valancy | B41J 2/16523 |
| 2008/0199240 | A1 | 8/2008 | Verlinden et al. | |
| 2010/0294152 | A1 | 11/2010 | Abbott et al. | |
| 2014/0146100 | A1 | 5/2014 | Zoltner et al. | |
| 2015/0197082 | A1 | 7/2015 | Rossell et al. | |
| 2017/0067687 | A1 * | 3/2017 | Hoffman, Jr. | F26B 25/02 |

(Continued)

FOREIGN PATENT DOCUMENTS

| | | | |
|---|---|---|---|
| CN | 1533894 | A | 10/2004 |
| CN | 1827380 | A | 9/2006 |
| CN | 1847015 | A | 10/2006 |

(Continued)

*Primary Examiner* — Bradley W Thies
(74) *Attorney, Agent, or Firm* — HP Inc. Patent Department

(57) ABSTRACT

It is hereby disclosed a direct-to-garment printer comprising: a print zone; a loading zone; and a conveyor to receive the garment and to move the garment bi-directionally along a transport direction between the print zone and the loading zone; wherein the printer further comprises a printbar located in the print zone, the printbar extending longitudinally along a width of the print zone and having a plurality of nozzles that span the width of the print zone.

15 Claims, 3 Drawing Sheets

(56) References Cited

U.S. PATENT DOCUMENTS

| | | | |
|---|---|---|---|
| 2018/0207958 | A1 | 7/2018 | Brandenberger et al. |
| 2018/0339531 | A1 | 11/2018 | Perera et al. |

FOREIGN PATENT DOCUMENTS

| | | | |
|---|---|---|---|
| CN | 102336058 | A | 2/2012 |
| CN | 102963126 | A | 3/2013 |
| CN | 103015103 | | 4/2013 |
| CN | 106004063 | A | 10/2016 |
| CN | 205890200 | U | 1/2017 |
| CN | 106956507 | A | 7/2017 |
| EP | 2897805 | B1 | 10/2018 |
| JP | 2002-103598 | A | 4/2002 |
| JP | 2006-342454 | A | 12/2006 |
| JP | 2014-004707 | A | 1/2014 |
| WO | 2012/032127 | A1 | 3/2012 |
| WO | WO-2016171684 | | 10/2016 |
| WO | WO-2018087119 | | 5/2018 |

* cited by examiner

DIRECT-TO-GARMENT PRINTING WITH STATIONARY PRINT NOZZLES

BACKGROUND

Textile printing is a growing field of technology wherein standard printers have a lower efficiency due to the particularities of textiles. Such particularities add further complexity to a printing system in case the user intends to print (i.e., deposit a printing fluid) directly onto a garment given the added complexity of dealing with different sizes, shapes, and materials of such garments.

In an example, direct-to-garment (DTG) printing systems are to be provided in shops or small to medium businesses that have space constrains, therefore, a compact system and with modularity capabilities may be advantageous.

BRIEF DESCRIPTION OF THE DRAWINGS

Various example features will be apparent from the detailed description which follows, taken in conjunction with the accompanying drawings, wherein.

DETAILED DESCRIPTION

Figure 1:
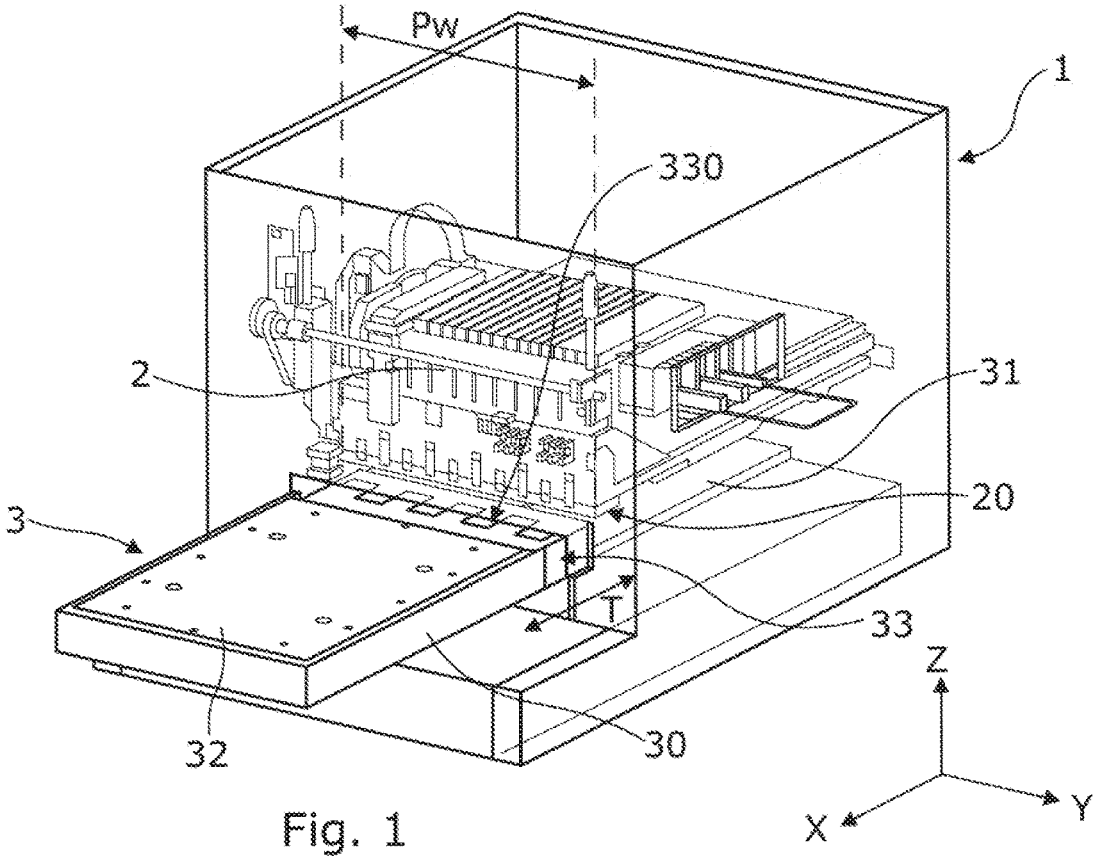
FIG. 1 is a perspective view of an example of direct-to-garment printer.

In the following description and figures, some example implementations of print apparatus, print systems, and/or printers are described. In examples described herein, a "printer" or a "printing system" may be a device to print content on a physical medium (e.g., textiles) with a print material (e.g., ink or toner). For example, the printer may be a wide-format print apparatus that prints latex-based print fluid on a print medium, such as a print medium that is size A2 or larger. The physical medium printed on may be a garment such as, e.g., a shirt, a cap or the like.

Moreover, a page-wide-array ("PWA") printing system is a printing system comprising a printhead that spans an entire printing area and may include thousands of nozzles. The PWA printhead thus has many more nozzles than the scanning-type printheads discussed above. The PWA printhead is formed on an elongated printbar. The printbar typically is oriented orthogonally to the print medium path. During operation, the printbar and PWA printhead are fixed while a print medium is fed adjacent to the printhead. The PWA printhead prints one or more lines at a time as the print medium moves relative to the printhead. This compares to the printing of multiple characters at a time as achieved by scanning-type printheads.

The present disclosure relates to a direct-to-garment printer comprising:

- a print zone;
- a loading zone;
- a conveyor to receive the garment and to move the garment bi-directionally along a transport direction between the print zone and the loading zone;

wherein the printer further comprises a printbar located in the print zone, the printbar extending longitudinally along a width of the print zone and having a plurality of nozzles that span the width of the print zone.

In an example, the conveyor comprises a print surface and a spittoon surface remote to the print surface. Also, the spittoon surface may be able along the width of the print zone. In a further example, the spittoon surface may extend along the width of the print zone thereby being a page-wide spittoon.

Moreover, the printbar may be movable along the width of the print zone by an indexing distance. Such indexing distance may help change the use rate of some of the nozzles thereby increasing their durability and improving IQ. In an example, such indexing distance may be a distance that amounts for up to 30% of the length of the die within the printbar or up to 50% of the die length of the printbar. For a die of approximately 30 mm (1 inch), the indexing distance would be a distance up to 8 mm, in a further example, the indexing distance is distance up to 13 mm and in a further example, the indexing distance is a distance between 8 mm and 13 mm.

In a further example, the printer may comprise a post-processing zone adjacent to the print zone and opposite to the loading zone being the conveyor to move the garment between the print zone and the post-processing zone. The post-processing zone may comprise at least one of: a dye sublimator, a heater, a dryer, a curing device, an unloading station and/or an overcoat applicator.

In an example implementation, the printer may comprise a second printbar couplable to the printbar thereby providing a second print zone and a second conveyor associated to the second printbar thereby providing a second loading zone.

Furthermore, it is herewith disclosed a direct-to-garment printing method in a printer that comprises

- a page-wide array of nozzles defining the width of print zone;
- a conveyor to move the garment bidirectionally in a direction perpendicular to the width of the print zone; and
- a controller to control to the page-wide array of nozzles and the conveyor;

being the controller to move the garment between a loading zone and the print zone and to eject a printing fluid on the garment while the garment moves along the print zone while maintaining the nozzles in a static position.

In an example of the method, the controller is to perform an indexing action by moving the nozzles in a direction parallel to the width of the print zone while the garment is outside the print zone.

In a further example, the print zone comprises a post-processing zone adjacent to the print zone opposite to the loading zone and the controller may be to move the garment from the loading zone, to the print zone and from the print zone to the post-processing zone. Moreover, the post-processing zone may comprise a dye-sublimator, a heater, a dryer, a curing device, an unloading station and/or an overcoat applicator.

Also, the printer may comprise a spittoon associated to the conveyor and wherein the controller is to move the conveyor to position the spittoon below the page-wide array of nozzles to perform a maintenance operation.

The present disclosure also refers to a non-transitory machine readable medium storing instructions executable by a controller, the medium storing instructions to control a page-wide array printer which comprises a set of nozzles defining the width of a print zone and a conveyor, wherein the controller is to move a garment between a loading zone and the print zone and to eject a printing fluid on the garment while the garment moves along the print zone while maintaining the nozzles in a static position FIG. 1 shows an example of a page-wide array printer 1, for example an inkjet printer, to print directly onto a garment, i.e., a direct-to-garment inkjet printer. Inkjet printers are, in general terms, controllable fluid ejection devices that propel droplets of printing fluid from a nozzle to form an image on a substrate (e.g., a garment) wherein such propelling can be achieved by different technologies such as, e.g., thermal injection or piezo injection.

The printer 1 comprises a printbar having a plurality of nozzles, for example, two rows of nozzles which may be for example, staggered or offset from one another. The nozzles are arranged to fire ink drops onto a garment as the garment is advanced through the printer apparatus in a direction indicated by arrow T (referred to hereinafter as the "media advance direction", also known as the media axis). The printer 1 comprises a controller for controlling the operation of the printer apparatus. The direction substantially perpendicular to the media advance direction will be referred to hereinafter as the "print zone width direction" and is also known as the pen direction, pen axis, print bar longitudinal direction or print-head direction.

In an example, the printer 1 may be provided with a plurality of printheads provided on the printbar. The printheads may be arranged so that their nozzles at least partially overlap in the media advance direction. Each printhead comprises nozzles that may be arranged, e.g., in two rows, with each row of nozzles being spaced by a distance, for example 21.167 microns (one twelve-hundredth of an inch) and the nozzles in the two rows may be mutually staggered by a staggering distance, so that the successive nozzles in each die are spaced, for example, by 21.167 microns (one twelve-hundredth of an inch), 1 micron being equal to 1 micrometer or $10^{-6}$ meters. It is noted that these dimensions are provided for illustrative purposes only.

FIG. 1 shows as printer 1 comprising a print engine 2 with a printbar 20 installed therein, the printbar extends along a widthwise direction (Y axis) thereby defining the width of the print zone of the printer. Also, the print engine 2 may comprise or be connected to a controller that controls the action of the print engine 2, including, defining the nozzle firing frequency of each of the nozzles within the printbar 20.

The print engine 2 may comprise a plurality of printbars 20, for example, a plurality of printbars along the media advance direction (T) or a plurality of printbars 20 extending in the widthwise direction. In any case the maximum distance between the nozzles of the printbars defines in a widthwise direction (a direction perpendicular to the media advance direction (T)) defines the width of the print zone ($P_w$).

Furthermore, FIG. 1 shows a conveyor 3 to move a garment from a loading zone towards the print engine, i.e., towards the printing zone. The conveyor 3 may be, for example, a tray 32 that may comprise a frame 30 and may be slidingly attached to a base 31 thereby providing a linear movement of a part of the conveyor 3 (for example, the tray 32) along a media path direction (T).

The conveyor 3 may comprise means to fix a garment thereto, in an example, the frame may be attached to the tray 32 by a hinged connection or similar pivotable connection so as to pivot between an open and a closed position. In the open position, the user may locate a garment over the tray and close the frame as to fixedly join the garment to the tray. In other examples, the conveyor may be provided with other fixing mechanisms such as, e.g., clamps or vacuum chambers to fix other types of garments such as, e.g., caps, shirts, textiles, or the like.

In use, the user loads a garment by providing it to the conveyor 3, the conveyor may comprise holding means for maintaining the garment fixed relative to part of the conveyor 3, in particular, the tray 32 and, subsequently, the conveyor 3 is to linearly move the garment along the media advance direction (T) towards the print zone.

The conveyor 3 moves the garment between a loading zone and the print zone along a media path direction (T), once the garment reaches the print zone it moves at a substantially constant speed through the print zone while the nozzles of the printbar 20 deposit printing fluid onto the garment. In a page-wide array configuration, since all of the width ($P_w$) of the print zone is provided with nozzles, the printbars 20 and, in consequence, the nozzles are maintained in a static position during a printing operation and it is the conveyor 3 the part of the printer that is to be in movement.

The page-wide array configuration of the example of FIG. 1 provides for a more compact design given that the print engine 2 can be design as to span substantially the print zone allowing for a printer 1 that occupies less space while maintaining the same width of print zone ($P_w$) when compared, e.g., to scanning printhead printers in which the printer requires start and stop areas at both sides of the print zone.

Also, a printbar 20 comprises nozzles that span the printbar being the first and last nozzle in the widthwise direction (Y axis) the nozzles that define the width of the print zone ($P_w$). Depending on the printout characteristics, certain nozzles of the printbar 20 may be exercised less than other nozzles. For example, a user may print most of the time using 2.5 cm margins, and on occasion use less than 2.5 cm margins. The nozzles in the 2.5 cm margin area, thus get exercised less regularly, and may clog more readily.

Therefore, a first mechanism to compensate for such uneven clogging and usage of the nozzles may be a so-called indexing movement of the printbar 20. In an indexing movement a lateral movement of the printbar is performed to ensure that nozzles that are not normally used perform a printing operation, i.e., a movement along the widthwise direction of the print zone is performed by the printbar 10. This movement is performed while no print is being made of the garment, for example, it can be performed when the conveyor 3 positions the garment outside the print zone or, in a further example, with the garment inside the print zone but no nozzle is ejecting printing fluid towards the garment.

Another mechanism to prevent nozzle clogging may be providing a spittoon 33 to the printer 1. The spittoon 33 allows for spitting of nozzles onto a spitting surface 330 that may have the capability to absorb waste ink. In an example, the spitting surface is a foam collecting spittoon, such spittoon is passive and potentially user replaceable after a certain amount of ink has been deposited. In a further example, the spitting surface comprises a suction, filtering, or collection system, e.g., by a system able to collect waste ink into an offline container. In an example implementation the conveyor 3 comprises a spittoon 33 attached thereto so that the conveyor 3 may be positioned along the media path direction (T) in a spitting location in which the nozzles eject printing fluid towards the spittoon 33.

In an example, the spittoon may be a page-wide spittoon or, in other words, a spittoon that has a dimension such that it covers at least the width of the print zone ($P_w$). In a further example, the spittoon may be a scanning spittoon that moves along the width of the print zone ($P_w$) in a scanning movement. In any case, the spittoon may be preferably attached to the carriage 3, either to the base 31 or the tray 32.

The printer 1 may also house a drop detector to measure nozzle health along the printbar 20 that closes the loop by determining if a cleaning operation, such as a spitting maintenance operation on the spittoon is needed. This allows a customized servicing strategy when a maintenance is determined to be needed by the drop detector.

The printer 1 may be provided with a servicing carriage that moves along the Printbar axis, where the Printheads are placed, that features a user consumable cloth cleaning mechanism (also known in the art as a wiper) capable of performing 500 wipe full span operations before replacement, this servicing carriage may also comprise the spittoon and/or the drop detector. In an example, the servicing carriage may be attached to the conveyor 3.

Figure 2:
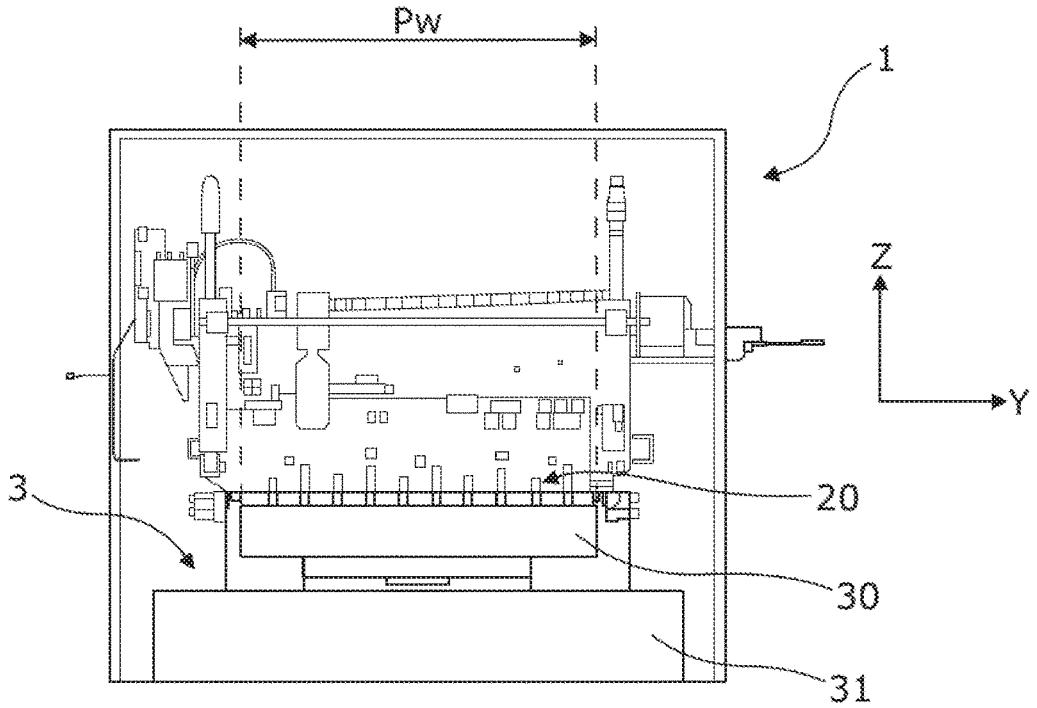
FIG. 2 is a front view of an example of direct-to-garment printer.

FIG. 2 is front view of the printer 1 of FIG. 1. FIG. 2 shows another view of the conveyor that comprises a base 31 and a tray 30 wherein the tray is to slide along the length of the base therefore moving the garment between a position away from the print zone and the print zone, for example, between a loading zone and a print zone or between a print zone and a post-processing zone.

Figure 3:
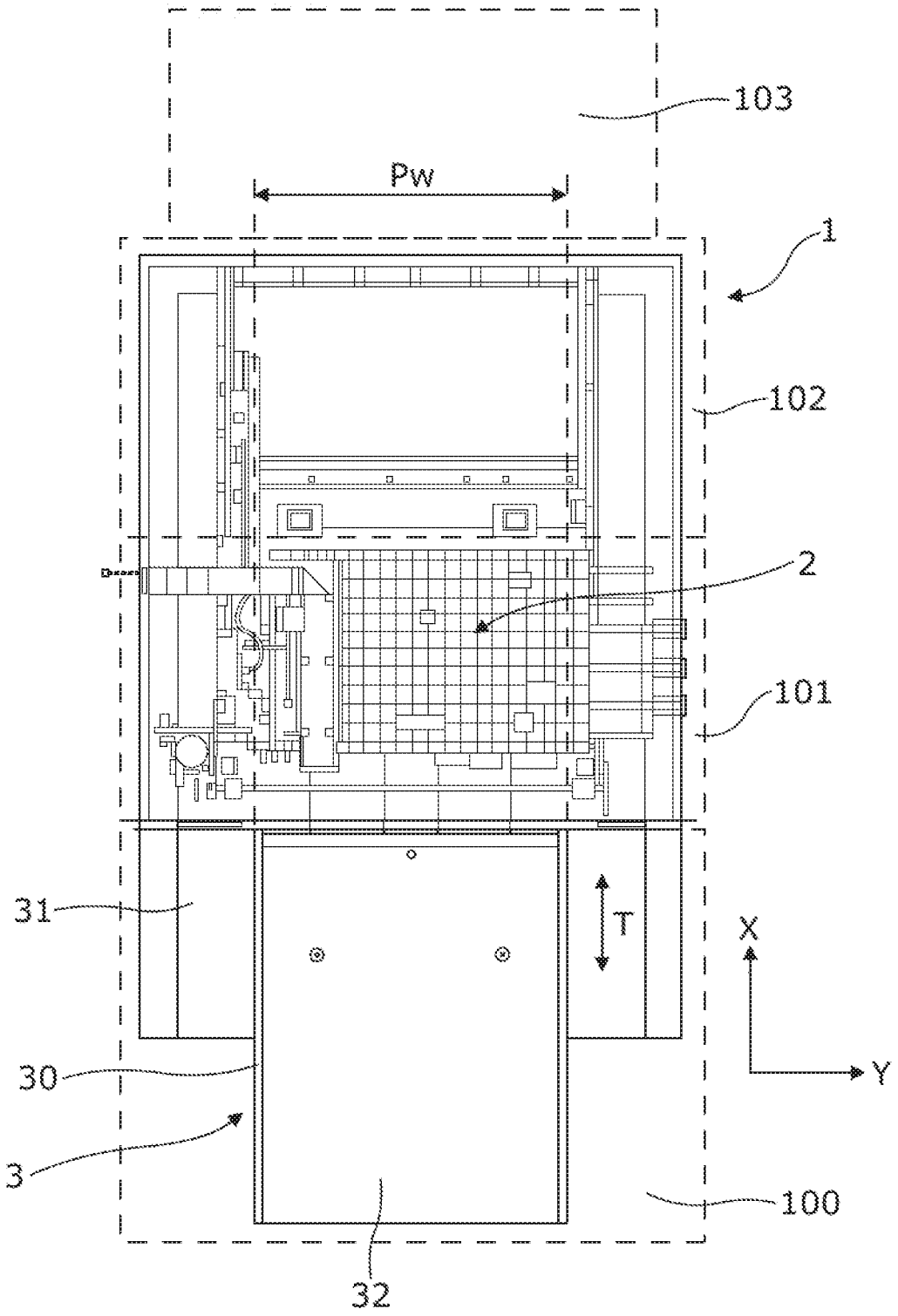
FIG. 3 shows a plan view of an example of direct-to-garment printer.

FIG. 3 shows an example wherein the printer comprises a loading zone 100 a printing zone 101, and two post-processing zones: a treatment zone 102; and an unloading zone 103.

The loading zone may comprise a zone wherein an operator or another device is to position a garment on the conveyor 3, in particular the conveyor tray 31 and the conveyor 3 is to fix the garment, e.g., by means of clamping and/or vacuum. Subsequently, the conveyor 3 is to move the garment along a media path direction (T) from the loading zone 100 towards the print zone 101 and move it along the print zone 101 at a substantially constant speed while the print engine 2 deposits the printing fluid onto the garment as to form an image. As mentioned above, the print engine 2 comprises a printbar 20 that spans the entire print zone 101, being the printbar 20 static while printing onto the garment at least with respect to a direction parallel to the print zone width ($P_w$).

Also, the conveyor may be to move the garment towards a post-processing zone that may be a treatment zone 102 wherein post-processing fluids may be applied to the garment (e.g., fixers, overcoats or the like). Also, the treatment zone may be a drying/curing zone wherein the garment may be treated by applying heat through impingement means or may be treated by light emitting sources to produce a drying/curing of the printing fluid.

Furthermore, in the example of FIG. 3 the printer 1 comprises an unloading zone wherein the conveyor may transport the garment as to unload it from the printer 1 and either finalize the printing process or may be fed to a subsequent device for its finishing and/or storage.

Figure 4:
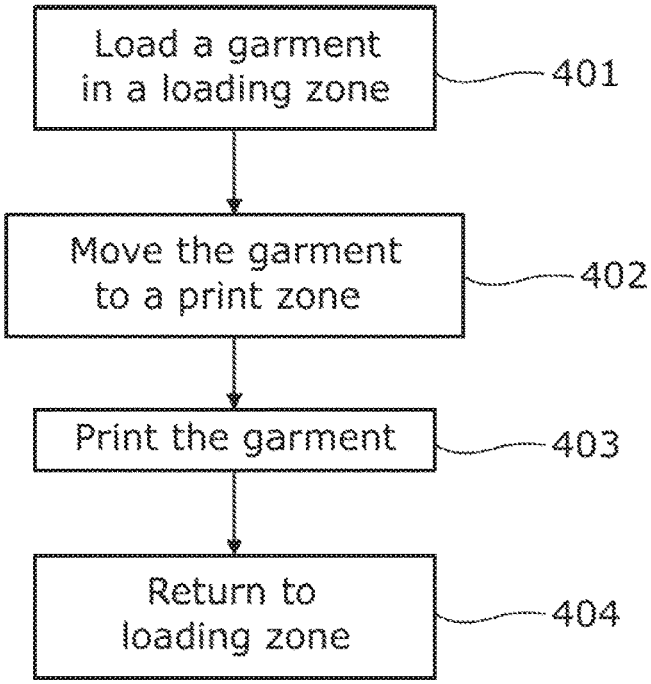
FIG. 4 shows an example method for printing a garment using a direct-to-garment printer.

FIG. 4 shows an example of a printing method using a direct-to-garment printer according to the present disclosure.

The method of claim 4 comprises loading a garment 401. The garment may be loaded, e.g., by a user or by automatic means in a loading zone of the printer. The loading may also comprise fixing the garment to a conveyor, e.g., by clamping the garment to a tray or to any appropriate section of the conveyor.

Then, the method comprises moving the garment towards the print zone 402. Then the garment is print 403 by the print engine as it ejects printing fluid towards the garment. In an example, the conveyor is to accelerate as it moves towards the print zone and, while the garment is being printed, move at a substantially constant speed.

Once the garment is print, e.g., once the full garment has passed the print zone, it may be returned to the print zone 404 by the conveyor as to unload it and load a new garment and perform a new printing operation.

Also, in an embodiment, the printer may be configured to perform several passes in a printing operation. This may be achieved by performing several passes of the garment through the print zone. For example, a first pass may be printed while the garment moves in a direction from the loading zone towards the print zone and a second pass may be performed in a second direction opposite to the first direction as the garment moves back towards the loading zone.

Figure 5:
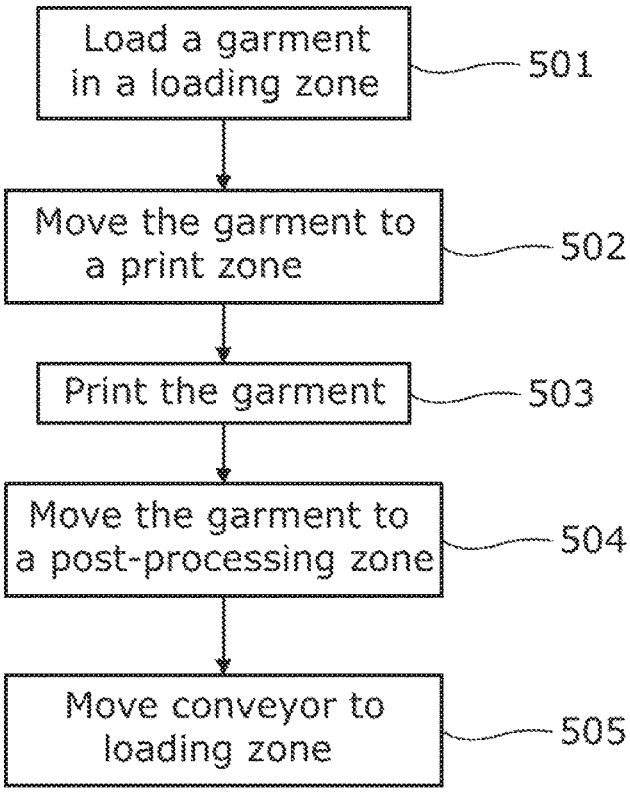
FIG. 5 shows another example method for printing a garment using a direct-to-garment printer.

FIG. 5 shows another method according to the present disclosure. In the example of FIG. 5 the user may load a garment 501 while the conveyor is in the loading zone. Subsequently, as in the case of the method of FIG. 4, the conveyor may move the garment towards the print zone 502, then, the garment may be print by a print engine 503. In the method of FIG. 5, once the garment is printed, it may be moved towards a post-processing zone 504. In this post-processing zone, the garment may be treated in order to obtain a finished garment. Examples of these treatment may be, e.g., application of an overcoat, application of other types of non-marking fluids to protect the printing fluids, heating by means of an impinging mechanism, heating by means of light generations (for example, narrow band LED, UV LED, infrared lamps, etc.) or even unloading the material.

In the above-mentioned examples, the printer may be provided with a controller and the controller may be coupled to the conveyor and the print engine as to control their operations. The controller may be a combination of circuitry and executable instructions representing a control program to perform the above-mentioned operations.

Further, some examples of controllers may be provided into a non-transitory machine-readable storage medium encoded with instructions executable by a processing resource of a computing device to perform methods described herein.

The preceding description has been presented to illustrate and describe certain examples. Different sets of examples have been described; these may be applied individually or in combination, sometimes with a synergetic effect. This description is not intended to be exhaustive or to limit these principles to any precise form disclosed. Many modifications and variations are possible in light of the above teachings. It is to be understood that any feature described in relation to any one example may be used alone, or in combination with other features described, and may also be used in combination with any features of any other of the examples, or any combination of any other of the examples.

The invention claimed is:

1. A direct-to-garment printer comprising:

a print zone;

a loading zone; and a conveyor to receive the garment and to move the garment bi-directionally along a transport direction between the print zone and the loading zone;

wherein the printer further comprises a printbar located in the print zone, the printbar extending longitudinally along a width of the print zone and having a plurality of nozzles that span the width of the print zone, wherein the print nozzles are to remain stationary and eject ink onto the garment as the conveyor conveys the garment in the print zone.

2. The printer of claim 1, wherein the conveyor comprises a print surface and a spittoon surface remote to the print surface.

3. The printer of claim 2, wherein the spittoon surface is movable along the width of the print zone.

4. The printer of claim 2, wherein the spittoon surface extends along the width of the print zone.

5. The printer of claim 1, wherein the printbar is movable along the width of the print zone by an indexing distance.

6. The printer of claim 5, wherein the indexing distance is up to 8 mm or up to 13 mm.

7. The printer of claim 1 further comprising a post-processing zone adjacent to the print zone and opposite to the loading zone being the conveyor to move the garment between the print zone and the post-processing zone.

8. The printer of claim 7, wherein the post-processing zone comprises: a dye sublimator, a heater, a dryer, a curing device, an unloading station and/or an overcoat applicator.

9. The printer of claim 1, wherein the printer comprises a second printbar couplable to the printbar thereby providing a second print zone and a second conveyor associated to the second printbar thereby providing a second loading zone.

10. A direct-to-garment printing method in a printer, comprising:

a page-wide array of nozzles defining the width of print zone;

a conveyor moving the garment bidirectionally in a direction perpendicular to the width of the print zone;

a controller controlling the page-wide array of nozzles and the conveyor; and the controller moving the garment between a loading zone and the print zone and ejecting a printing fluid on the garment while the garment moves along the print zone while maintaining the nozzles in a static position.

11. The method of claim 10, wherein the controller is to perform an indexing action by moving the nozzles in a direction parallel to the width of the print zone while the garment is outside the print zone.

12. The method of claim 10, wherein the print zone comprises a post-processing zone adjacent to the print zone opposite to the loading zone and wherein the controller is to move the garment from the loading zone, to the print zone and from the print zone to the post-processing zone.

13. The method of claim 12, wherein the post-processing zone comprises a dye-sublimator, a heater, a dryer, a curing device, an unloading station and/or an overcoat applicator.

14. The method of claim 10, wherein the printer comprises a spittoon associated to the conveyor and wherein the controller is to move the conveyor to position the spittoon below the page-wide array of nozzles to perform a maintenance operation.

15. A non-transitory machine readable medium storing instructions executable by a controller, the medium storing instructions to control a page-wide array printer which comprises a set of nozzles defining the width of a print zone and a conveyor, wherein the controller is to move a garment between a loading zone and the print zone and to eject a printing fluid on the garment while the garment moves along the print zone while maintaining the nozzles in a static position.

* * * * *